US011103412B1

(12) United States Patent
O'Brien

(10) Patent No.: US 11,103,412 B1
(45) Date of Patent: Aug. 31, 2021

(54) CUSHION FOR DECOMPRESSING THE HUMAN SPINAL COLUMN

(71) Applicant: Patrick Michael O'Brien, Forestburg, TX (US)

(72) Inventor: Patrick Michael O'Brien, Forestburg, TX (US)

( * ) Notice: Subject to any disclaimer, the term of this patent is extended or adjusted under 35 U.S.C. 154(b) by 890 days.

(21) Appl. No.: 14/544,579

(22) Filed: Jan. 23, 2015

Related U.S. Application Data

(60) Provisional application No. 61/965,191, filed on Jan. 27, 2014.

(51) Int. Cl.
*A61H 1/02* (2006.01)
*A61G 7/07* (2006.01)

(52) U.S. Cl.
CPC ..... *A61H 1/0296* (2013.01); *A61G 7/072* (2013.01)

(58) Field of Classification Search
CPC ..... A47G 9/10; A47G 9/1081; A47G 9/109; A47G 2009/1018; A61G 7/072; A61H 1/0296; A61H 2201/1609; A61H 2201/1614; A61H 2205/04; A47C 20/02; A61F 5/042
USPC ..... 602/32, 33, 35; D6/601
See application file for complete search history.

(56) References Cited

U.S. PATENT DOCUMENTS 3,521,310 A 7/1970 Greenawalt
4,832,007 A 5/1989 Davis, Jr. et al.
4,941,478 A 7/1990 Takeuchi et al.
5,173,979 A * 12/1992 Nennhaus ..... A61G 7/0755 5/490
5,307,532 A * 5/1994 Connell ..... A47G 9/10 5/636
D353,004 S * 11/1994 Boland ..... D24/183
5,457,832 A 10/1995 Tatum
5,519,907 A 5/1996 Poths
5,644,809 A * 7/1997 Olson ..... A47G 9/10 5/636
D396,373 S * 7/1998 Reale ..... D6/601
5,778,469 A 7/1998 Festa
7,536,737 B1 * 5/2009 Orta-Perez ..... A47G 9/10 5/636

(Continued)

FOREIGN PATENT DOCUMENTS

GB 2356560 A * 5/2001 ..... A47C 20/026

OTHER PUBLICATIONS

Definition of "attached", Apr. 30, 2019, Merriam-Webster, www.merriam-webster.com/dictionary/attached (Year: 2019).*

(Continued)

*Primary Examiner* — Nicholas F Polito
(74) *Attorney, Agent, or Firm* — Robert E. Wise

(57) ABSTRACT

A cushion for decompressing the human spinal column comprises a body support surface, a first short flat bottom surface, a longer second flat bottom surface, wherein the first bottom surface and the second bottom surface intersect and are angled at a particular angle lying within the range of 120 degrees to 150 degrees, but preferably at 135 degrees. A cushion for decompressing the human spinal column comprise a body support surface, and a curved bottom surface wherein the curve of the bottom surface increases or decreases in radius from one end to the other. The curve of the bottom surface may have the shape of an incomplete portion of a two-dimensional spiral.

2 Claims, 12 Drawing Sheets

(56) References Cited

U.S. PATENT DOCUMENTS

| | | | | |
|---|---|---|---|---|
| D736,542 | S * | 8/2015 | Fenton | A47C 20/02 D6/601 |
| 9,192,503 | B1 * | 11/2015 | Peterson | A61H 1/0296 |
| 10,080,450 | B2 * | 9/2018 | Shin | A47G 9/109 |
| 2003/0000018 | A1 * | 1/2003 | Lanteri | A47G 9/10 5/636 |
| 2005/0125901 | A1 * | 6/2005 | Nichols | A47G 9/10 5/636 |
| 2016/0324711 | A1 * | 11/2016 | Richmond | A61H 1/0292 |

OTHER PUBLICATIONS

Definition of "connected", Apr. 30, 2019, Merriam-Webster, www.merriam-webster.com/dictionary/connected (Year: 2019).*

Definition of "joined", Apr. 30, 2019, Merriam-Webster, www.merriam-webster.com/dictionary/joined (Year: 2019).*

* cited by examiner

CUSHION FOR DECOMPRESSING THE HUMAN SPINAL COLUMN

CROSS-REFERENCE TO RELATED APPLICATIONS

This application claims the benefit of U.S. provisional patent application Ser. No. 61/965,191 filed on Jan. 27, 2014 under 35 U.S.C. 111(b).

STATEMENT REGARDING FEDERALLY-SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

(1) Field of the Invention

This invention comes within the field of cushions which support a human during rest. More particularly, this invention is a cushion which tends to decompress the human spine while the human rests upon the cushion.

(2) Description of Related Art

One of the inevitable things about aging is that the human spine slowly compresses due to gravity. It is not unusual for people to become shorter as they age, primarily because their spine compresses and shortens. People who sit a lot during the day sometimes feel that their spine or back could use a good stretch.

People have used certain products to stretch or decompress their spine or back or body. Most of these products involve inverting the person's body while suspending it from their feet or pelvis. This causes a substantial part of the body weight to stretch or decompress the person's spine or body due to gravity pulling the inverted body downwards. Boots with hooks are used to suspend the person from their feet by raising each boot up and hooking it onto a bar or other support. When both boots are hooked, the person can then hang from the boots, with their head and body inverted from the normal upright position. Another product allows the person to attach their body to a planar support by securing their feet, legs, or waist to the planar support. The planar support, which is roughly as long as the height of the user, can pivot generally at the middle. Once the person is attached to the planar support, the planar support pivots on a suspension frame, such that the person is inverted from the normal upright position and their head and body hang downwards. Gravity then acts to pull upon and stretch the spine and the body from the place where the person is attached to the planar support.

The problem with inverting a person is that it often feels uncomfortable, particularly as time passes, to remain in an upside-down position. Fluids tend to flow upwards in the body, it is difficult to swallow, the head can get "stuffy", and people are not used to seeing things upside-down. The person cannot accomplish normal tasks easily in an inverted position. It is difficult to eat or drink. It is difficult to read or watch television. It is difficult to work. One cannot move about because one is attached to a planar support or to a hanger. It is difficult even to rest or sleep.

To use the known devices on a daily basis, one would have to transport a pair of boots with hooks, or a large planar support and its associated suspension frame. They are bulky and heavy and difficult to carry.

It would be desirable if there were a spinal decompression means for stretching, decompressing, or forcibly extending the spine in a safe manner such that the person would not be inverted and could at least rest normally. It would be desirable if the spinal decompression means would be relatively small and light and easy to carry.

BRIEF SUMMARY OF THE INVENTION

A novel spinal decompression device comprises a headrest that can be placed beneath the head and neck of a person as the person lies flat on the back on a bed, floor, or other relatively flat surface generally parallel to the ground, or on the ground itself. The novel headrest can have a top surface that is generally curved. The novel headrest has a bottom surface that comprises two generally planar surfaces that intersect at a line and are angled with respect to one another, one planar surface being significantly smaller than the other planar surface. The angle between the two planar surfaces that intersect can be approximately 135 degrees. The angle can range from about 120 degrees to about 150 degrees.

To use the novel spinal decompression device of this invention, the person would place the smaller planar bottom headrest on the surface on which the person will lie down on the person's back. The headrest is initially placed upon the smaller bottom planar surface such that the larger bottom planar surface is angled somewhat upwardly from the surface on which the person will lie. The person then lies down with the person's head and neck on the headrest. The person then pushes their head back against the headrest. This added force or weight causes the headrest to pivot around the line at which the two bottom surfaces intersect, and the headrest will rotate onto the larger bottom surface. This rotation of the headrest will impart to the person's head a force that will move the person's head away a short distance from their body, thus slightly stretching or decompressing their spine. The spinal decompression device will tend to maintain the person's head in this position while the person continues to lie on the device if they do not shift their body in the direction of their head. Thus, the person's spine can remain in a stretched or decompressed state for some period of time. This stretching or decompressing for a period of time will tend to somewhat counteract the compression of the spine caused by gravity while the person is standing or sitting erect. The stretching or decompression of the spine can provide the user with a pleasant sensation and can provide relief from back or neck pain.

A novel cushion comprises a body support means for supporting a portion of a human body wherein the body support means has a first bottom surface and a second bottom surface which intersect each other at an angle. The angle of intersection can lie between 120 degrees and 150 degrees, but is preferably about 135 degrees. The intersection of the first and second bottom surfaces can be a line or a relatively long narrow curved surface which will be the axis of rotation in use. The cushion can be of a uniform width. The first bottom surface should be shorter than the second bottom surface. Preferably, the first bottom surface is about half the length of the second bottom surface, but can fall in the range of from 1.5:1 to 2.5:1. The first and second bottom surfaces should be of a relatively hard material that deforms relatively little when a user lies on the cushion. At least a portion of the top of the cushion, on which the user will lie, can be of a relatively soft material that will be comfortable for the user to lie on. The top surface of the cushion should have a shape that will enable the user to rotate the cushion from lying on its first bottom surface to lie on its second bottom surface while the user lies with the user's neck and a portion of the user's head on the top surface of the cushion. To use the cushion, the user lies supine on a resting surface with the cushion placed between the resting surface and the neck and head of the user such that the cushion initially lies on its first bottom surface. Then, without moving the user's torso, the user extends the user's head away from the user's shoulders, thereby rotating the cushion about its axis of rotation so that the cushion lies on its second bottom surface. The rotation of the cushion stretches or decompresses the user's spinal column. Thereafter, the user lies in this position for a period of time. When the user arises, the user's spinal column will have slightly stretched or decompressed, which provides the user with a restful or desirable feeling.

Alternatively, instead of a bottom surface comprising two relatively flat surfaces, the bottom surface of the cushion can comprise a surface curved in one dimension, wherein the radius of curvature of the curved surface is relatively large toward one end of the bottom surface and relatively small toward the other end of the bottom surface. To use this alternative embodiment, the user would initially place the cushion between the user's neck and the resting surface such that the cushion lay on the end that has a relatively small radius of curvature, and then move the user's head away from the user's shoulders to rotate the cushion such that it comes to rest on the portion of the bottom surface that has a relatively larger radius of curvature. The user then rests for a period of time in this position. When the user arises, the user's spinal column will have slightly stretched or decompressed, which provides the user with a restful or desirable feeling.

Using the principle of this invention, cushions with other bottom surface designs can be designed by persons of ordinary skill in this art who have read this entire disclosure, and those designs would come within the scope of this invention.

DETAILED DESCRIPTION OF THE PREFERRED EMBODIMENTS OF THE INVENTION

Figure 4:
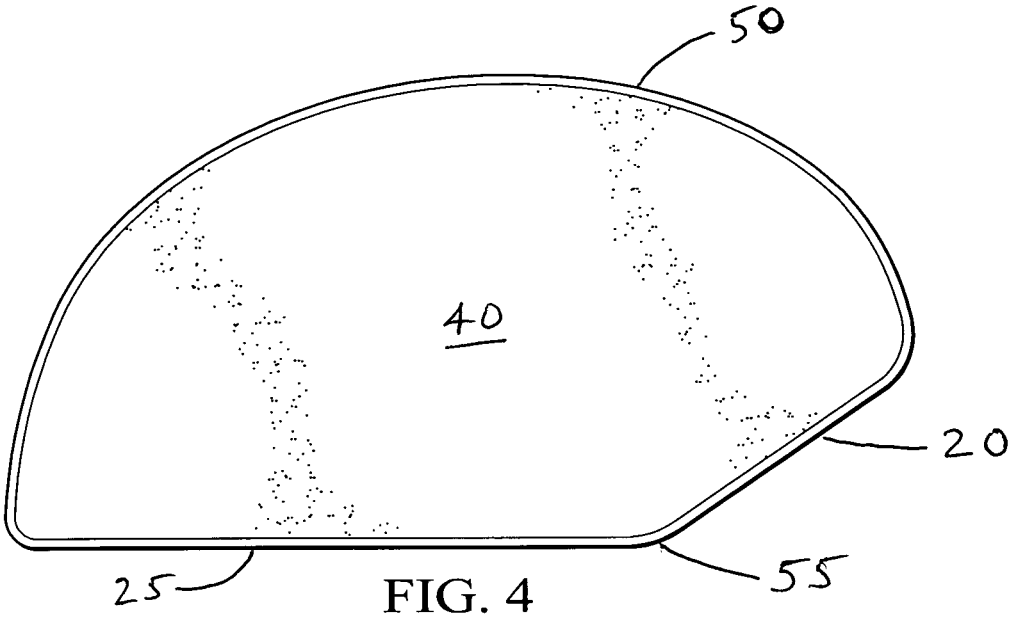
FIG. 4 shows a side view of the first embodiment of this invention.
Figure 5:
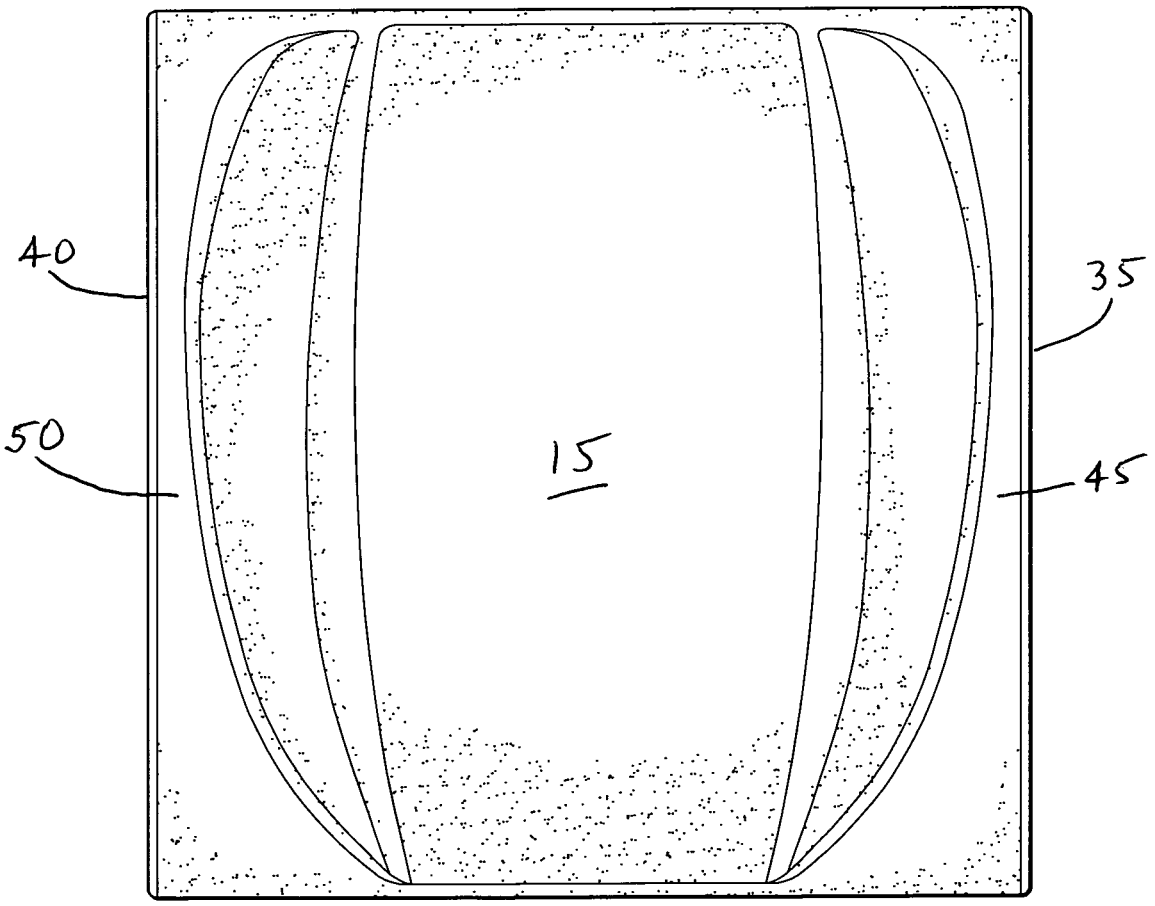
FIG. 5 shows a top view of the first embodiment of this invention.

The first embodiment of this invention is shown in FIGS. 1 to 8. A cushion 10 has a body support surface 15, a first bottom surface 20, and a second bottom surface 25. The first bottom surface 20 and the second bottom surface 25 can both be relatively flat surfaces, which intersect at corner 55. The corner 55 could be the line of intersection of the two bottom surfaces or it could be slightly rounded as shown in FIG. 4. The first bottom surface 20 and the second bottom surface 25 are angled to one another at a predetermined angle 30. The predetermined angle can be a particular angle within the range from 120 degrees to 150 degrees, but is preferably an angle within the range of 130 to 140 degrees. A preferred angle between the first bottom surface 20 and the second bottom surface 25 is 135 degrees.

Figure 1:
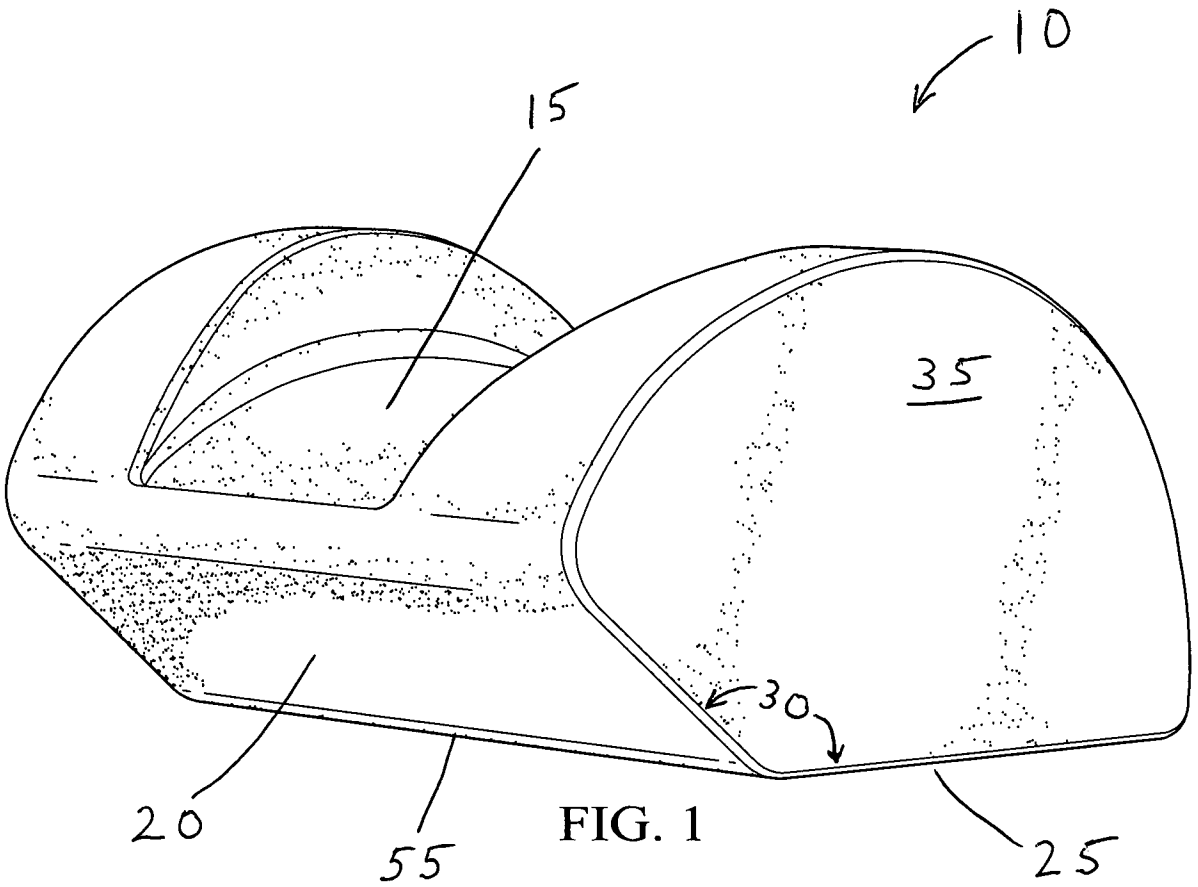
FIG. 1 shows a perspective view of a first embodiment of this invention.
Figure 2:
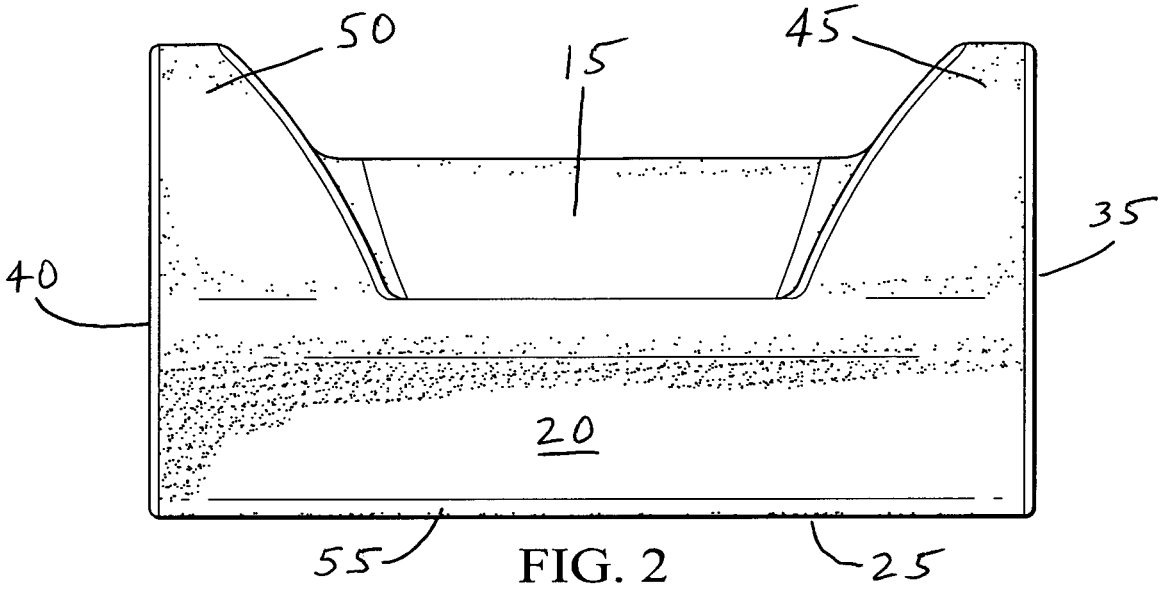
FIG. 2 shows a first end view of the first embodiment of this invention.
Figure 3:
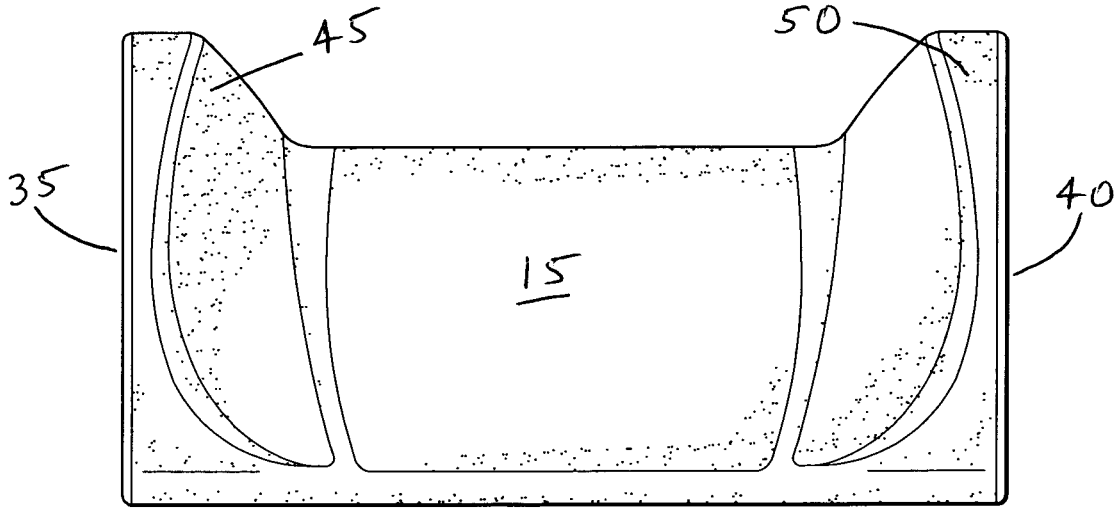
FIG. 3 shows a second end view of the first embodiment of this invention.

As seen in FIG. 2, the cushion 10 can have a side surface 35 on the right of the cushion 10 in this figure, and a side surface 40 on the left of the cushion 10 in this figure. In this preferred embodiment the sides 35 and 40 can be approximately flat, generally parallel, and equal in size when there is nothing pressing on the cushion. But it would be possible for a person of ordinary skill in this art who has read this entire disclosure to design side surfaces that were not flat and/or not parallel and/or not equal in size to one another. The side surfaces 35 and 40 are not critical to this invention, so their shape, size, and orientation are matters of design choice.

Also seen in FIG. 2 are the fact that body support surface 15 is configured as a valley between side bolster 45 on the right in the figure and side bolster 50 on the left in the figure. The two side bolsters 45 and 50 function to maintain the head and neck of the user positioned on the cushion 10 so that the person's head or neck do not accidentally fall off the side of the cushion 10, particularly as the cushion 10 rotates or rocks as described below. The two side bolsters 45 and 50 are part of my preferred embodiment, but not necessary to the practice of my invention. It would be possible to eliminate one or both bolsters so that the body support surface 15 extended uninterrupted from side surface 35 to side surface 40. Further, the size and shape of the bolsters and their orientation are not critical to the preferred embodiment, but are simply matters of design choice. The side bolsters 45 and 50 can be made out of the same material as the body support surface 15, or can be made of material that is different.

Figure 6:
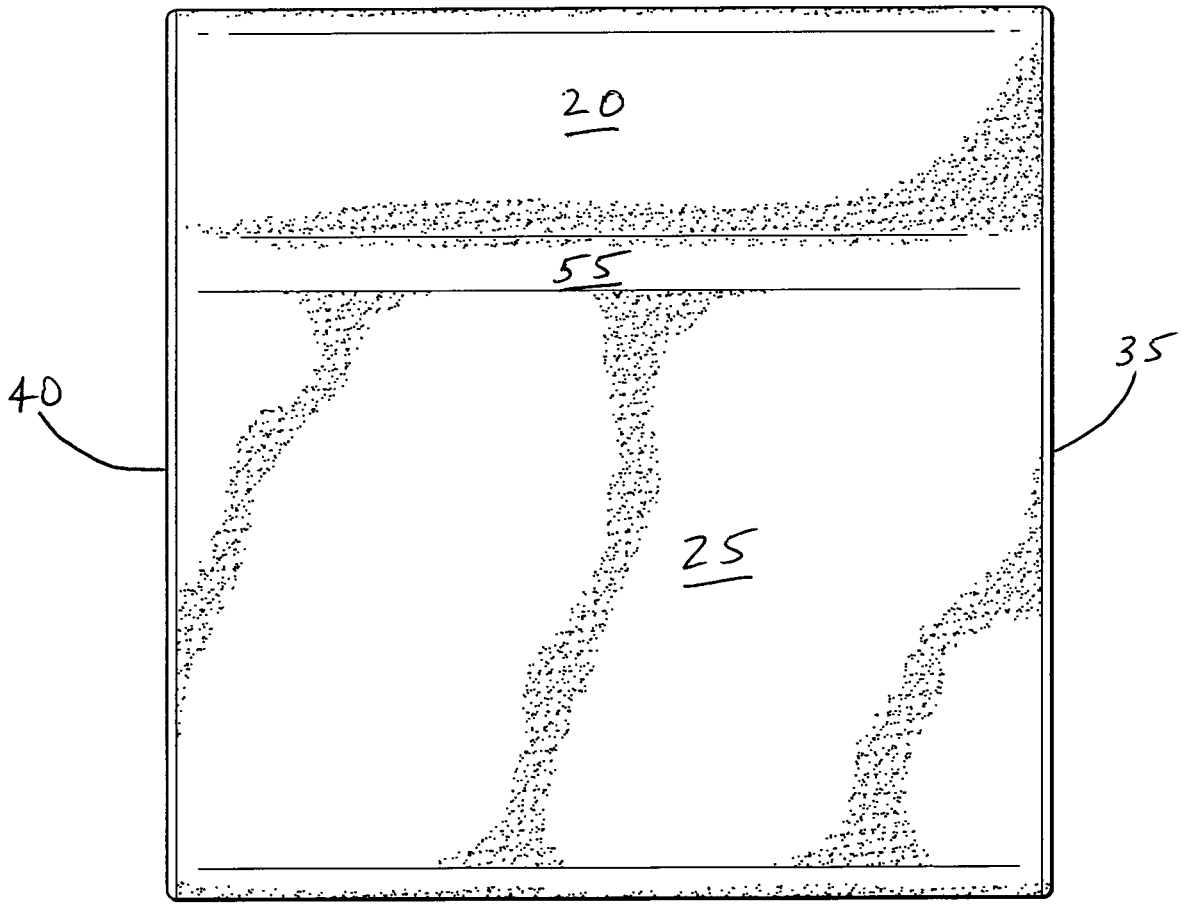
FIG. 6 shows a bottom view of the first embodiment of this invention.

The first bottom surface 20 and the second bottom surface 25 both have the same width, as is seen in FIG. 6, but the second bottom surface 25 is designed to be significantly longer than the first bottom surface 20. In this preferred embodiment, the second bottom surface may be about twice as long as the first bottom surface. However, the ratio of the length of the second bottom surface 25 to the first bottom surface 20 can be any particular ratio between 1.5:1 to 2.5:1. The choice of relative sizes of both the first and the second bottom surfaces is a matter of design choice as long as the cushion works as explained below with respect to FIGS. 7 and 8.

The cushion also has a body support surface 15 shaped in any suitable design such that a person can lay the person's head and neck on the body support surface 15 of the cushion 10 and comfortably rest or sleep. The design of the body support surface 15 in FIGS. 1 to 8 is merely a preferred embodiment. Persons of ordinary skill in this art, after reading this entire disclosure, will be able to design obvious alternatives to the top surface design shown in the drawings.

Both the first bottom surface 20 and the second bottom surface 25 are made of one or more relatively firm materials such that neither surface will deform appreciably in normal use. The remaining part of the cushion 10 can be of the same or of a different material than the two bottom flat surfaces 20 and 25. But, the remaining part of the cushion should be made of a material such that the angle between the first bottom surface 20 and the second bottom surface 25 will not change much when the cushion is used as described below with respect to FIGS. 7 and 8. It is apparent that the bottom surfaces meeting at the corner 55 form a rocker that can rock back and forth about the corner 55. One could think of the cushion as rotating about corner 55 when it rotates about that corner.

A suitable material for the first bottom surface 20 and the second bottom surface can be chosen from one or more of Styrofoam, rubber, plastic, or the like. It is also possible that there can be a relatively firm strength element or elements inside the cushion 10 near one or both of the first bottom surface 20 and the second bottom surface 25 with a relatively soft and thin layer of soft material between the strength element(s) and the first or second bottom layer(s). Persons of ordinary skill in this art, having read this entire disclosure, will be able to design various embodiments that accomplish the purpose of this invention. The material that forms the body support surface can be chosen from one or more of foam rubber, felt, or any other material normally used in standard cushions and pillows.

Figure 7:
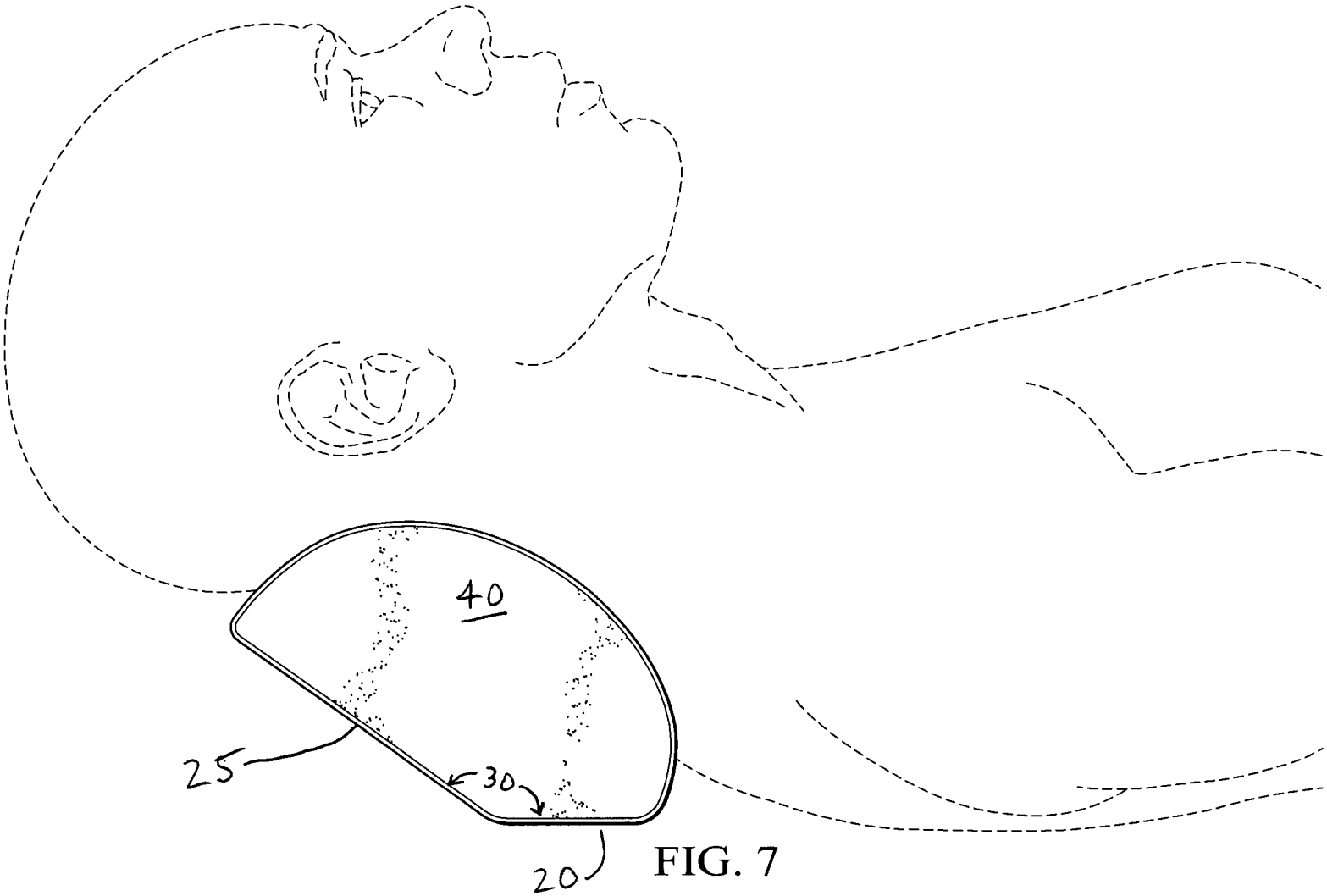
FIG. 7 shows the first embodiment in use in its initial position.

The usage of the cushion 10 can be explained with reference to FIGS. 7 and 8. When a person desires to lie down with the person's head and neck on the cushion 10, the person first places the first bottom surface 20 onto the surface on which the person will lie, and the person places his or her neck and head onto the body support surface 15 of the cushion 10 as shown in FIG. 7. It will likely be necessary for the person to hold the cushion 10 with his or her hands when the person places his or her head and neck on the cushion 10 with the cushion having its first bottom surface 20 on the surface on which the person will lie. The person can then take his or her hand off of the cushion. The person then pushes his or her head generally towards the top of the person's body while maintaining the person's torso in a relatively fixed position, so that the cushion rotates about the line where the first and second bottom surfaces intersect. This causes the cushion 10 to move from lying on its first bottom surface 20 to lie on its second bottom surface 25. The effect of this on the person is to gently stretch or extend the person's head with respect to the person's torso, thereby causing the person's spine to decompress. The stretching or decompression of the spine is the desired result of the present invention. The person will then rest or sleep in this position for the desired length of time before getting up, and the cushion 10 will maintain the person's spine in the stretched or decompressed state during the time the person continues to lie on the cushion 10. The effect of resting or sleeping in a position wherein the spine is somewhat decompressed has been found to be more desirable than resting or sleeping on a normal pillow that does not stretch or decompress a person's spine.

It should be noted that the slight convex rounding of the body support surface 15 has the result of maintaining the person's spine in a stretched or decompressed state while the cushion is in use. The convex shape of the body support surface is required to be a shape that will stretch or decompress the person's spine when the cushion rotates as explained above, and then will maintain the person's spine in a stretched or decompressed state for the period during which the person continues to lie on the cushion 10. Some possible shapes of the body support surface 15 will fail to accomplish this. For example, a concave surface for the body support surface 15 will likely not accomplish the objectives of this invention and it would likely not be comfortable for most people. The advantage of the convexly curved body support surface 15 shown in FIGS. 1 to 8 is that it generally follows the contour of a person's neck and head as seen in FIGS. 7 and 8, it is comfortable to most people, and it maintains the person's spine in a stretched or decompressed state during the time in which the person continues to lie on the cushion 10. However, persons of ordinary skill in this art who read this entire disclosure will be able to design body support surfaces 15 having different obvious shapes which accomplish the purposes of this invention. These designs come within the scope of this invention.

The overall shape of the cushion 10 is a matter of design choice that can be accomplished by persons of ordinary skill in this art after reading this entire disclosure. The important aspect of the first embodiment of cushion 10 is the first and second bottom surfaces 20 and 25, the relative angle 30 between them, and their relative lengths.

Figure 8:
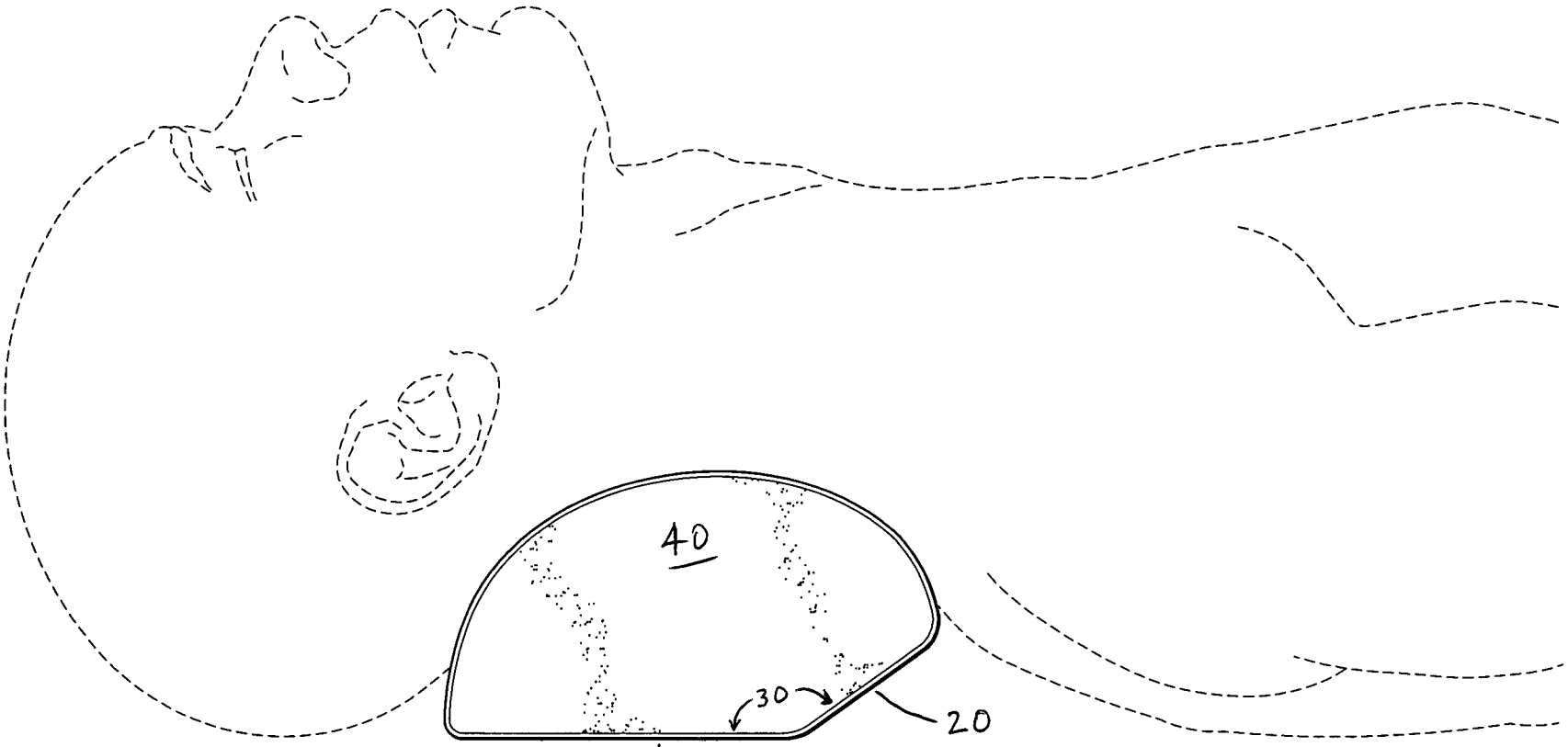
FIG. 8 shows the first embodiment in use in its final position.

The functioning of the cushion 10 in use can be seen in FIGS. 7 and 8. In FIG. 7, the user has laid down supine on a resting surface (not shown), which could be the floor, a sofa, a bed, or the like. The user has positioned the cushion 10 beneath the posterior surface of his or her neck and lower head such that the cushion's first bottom surface 20 lies flat on the resting surface. In so doing, the person simply lies down on the cushion 10 in the manner that is normal to a person lying down on a pillow or cushion. However, the person may need to use one or both hands to hold the cushion 10 in the orientation shown in FIG. 7 while the person lies down on the resting surface. Then, the person gently causes his or her body to extend in the direction of the top of the person's head and away from the person's shoulders, which causes the cushion 10 to rotate counterclockwise in FIGS. 7 and 8 about the intersecting corner 55 such that the cushion 10 has its second bottom surface 25 lying flat on the resting surface. The cushion 10 will rotate approximately the same angle as the relative angle 30 between the first and second bottom surfaces to rotate from the position in which first bottom surface 20 lies flat on the resting surface to the position where second bottom surface 25 lies flat on the resting surface.

During the rotation of the cushion 10 about its corner 55, the torso and legs of the user will remain unmoved on the resting surface. However, during the rotation of the cushion 10 about its corner 55, the user's head will be forced by the cushion 10 to extend a small distance toward the top of the person, which would be to the left in FIGS. 7 and 8. This small extension of the person's head from the person's torso will stretch at least part of the person's spinal column and tend to continually decompress the spinal column while the person continues to lie on the cushion 10. Spinal decompression has been found to promote a restful feeling. The use of my novel cushion during a period of rest will counter the spinal compression that occurs in the user's spine during a day of standing or sitting upright, and will provide most users with a rested feeling and may soothe backaches due to spinal compression.

Figure 9:
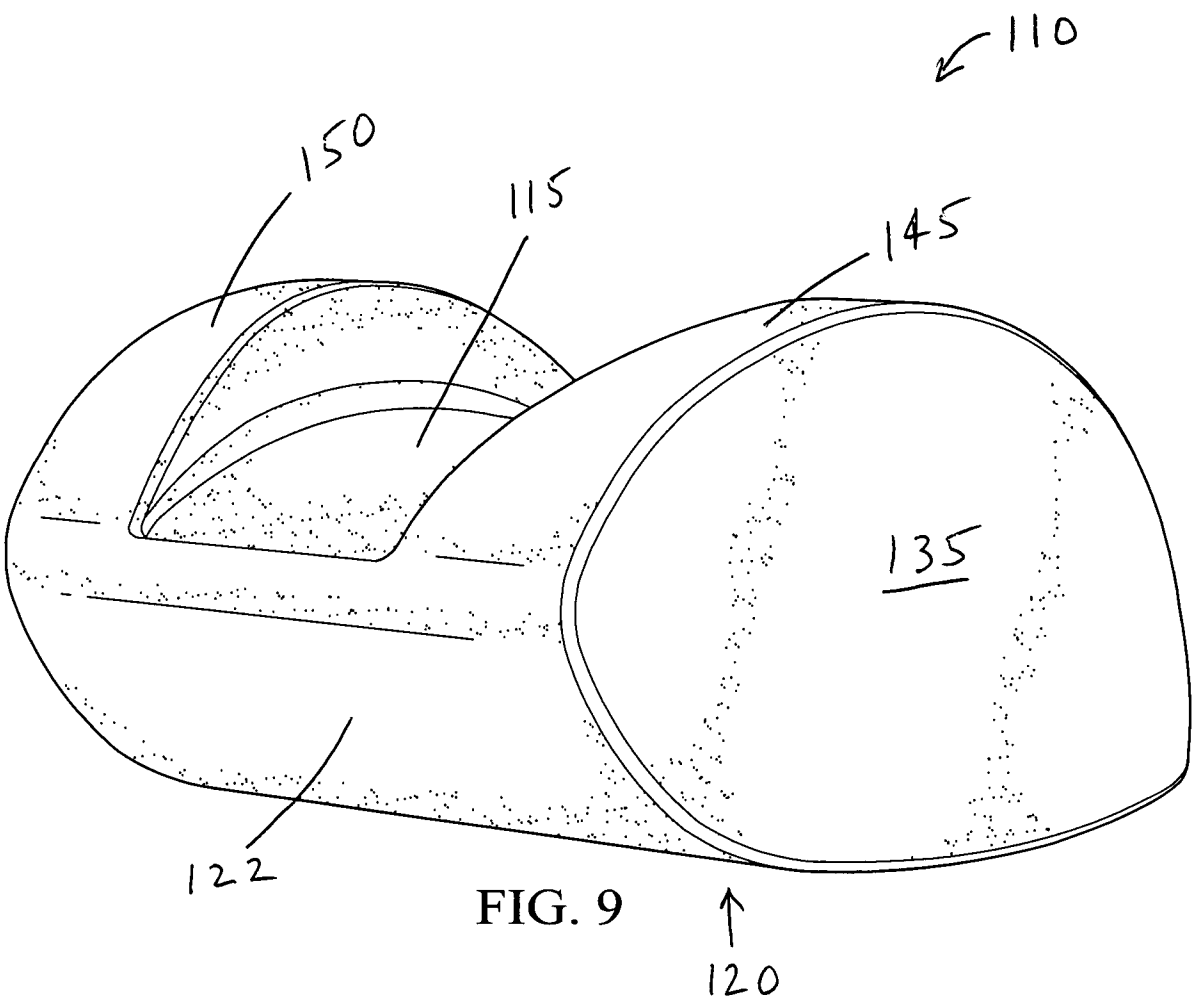
FIG. 9 shows a perspective view of a second embodiment of this invention.
Figure 10:
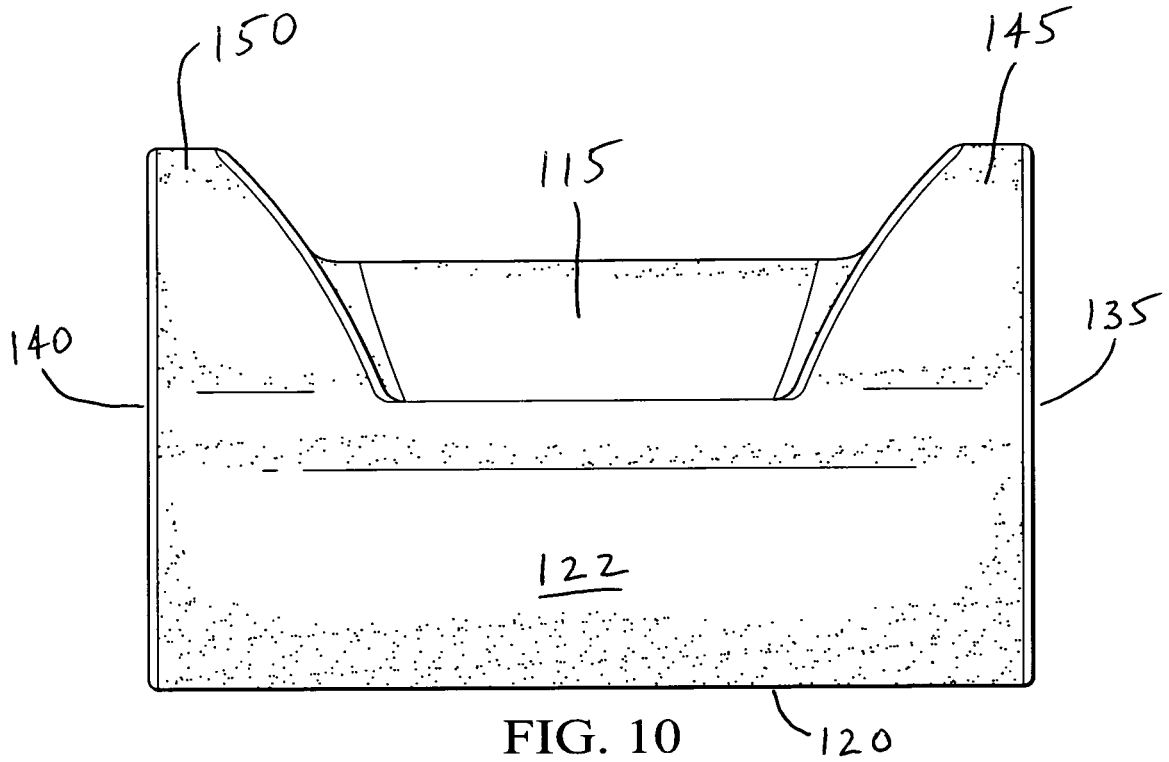
FIG. 10 shows a first end view of the second embodiment of this invention.
Figure 11:
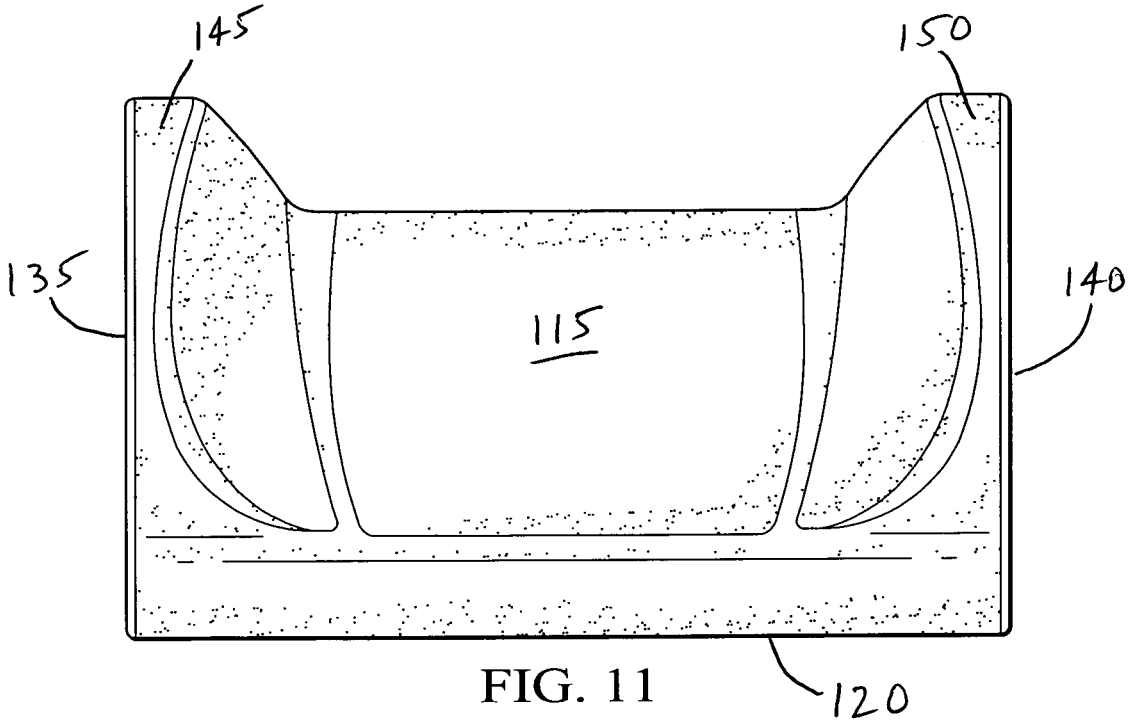
FIG. 11 shows a second end view of the second embodiment of this invention.

The second embodiment of this invention is illustrated in FIGS. 9-16. FIG. 9 shows a cushion 110 comprising a body support surface 115 on which a person can lie. The cushion 110 has a bottom surface 120, at least a portion of which is curved in one dimension.

The cushion 110 has a first side 135 and a second side 140. At the top of the cushion 110, there is a first bolster 145 that merges with the first side 135 of the cushion 110, and a second bolster 150 that merges with the second side 140 of the cushion 110. The body support surface 115 is disposed between the first bolster 145 and the second bolster 150 with the body support surface 115 lower than the surrounding bolsters as is seen in the figures.

Figure 12:
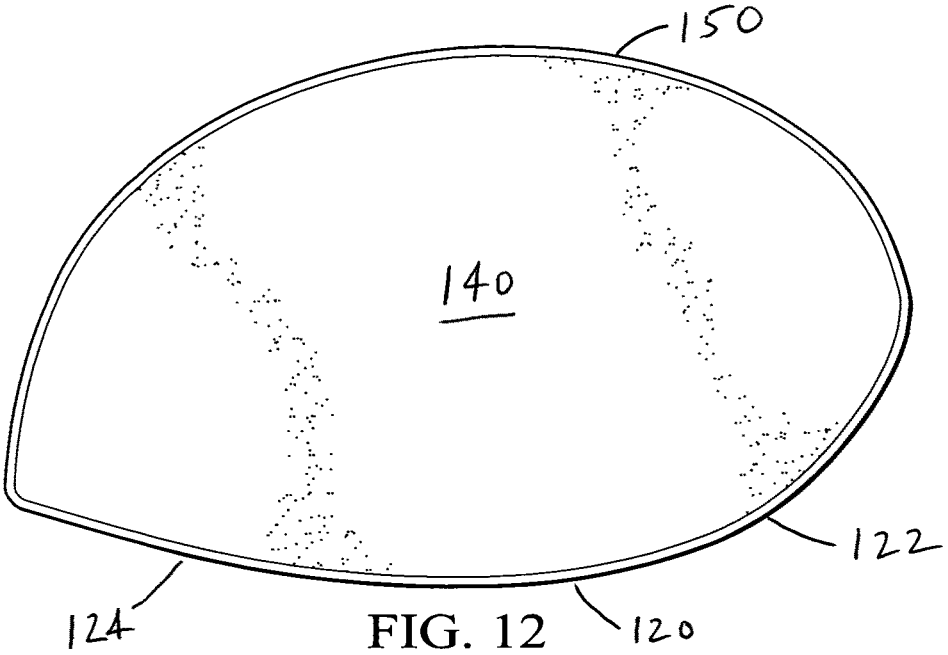
FIG. 12 shows a side view of the second embodiment of this invention.
Figure 13:
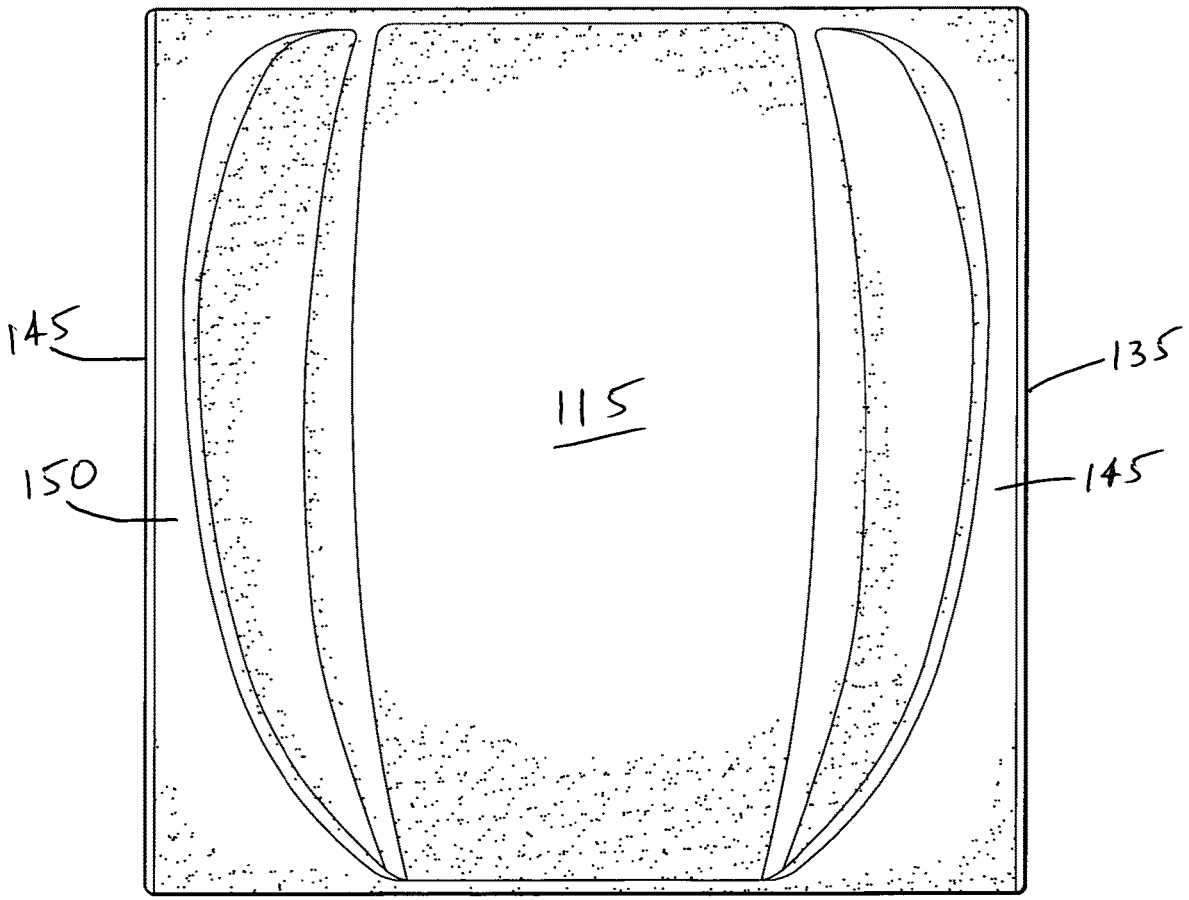
FIG. 13 shows a top view of the second embodiment of this invention.
Figure 14:
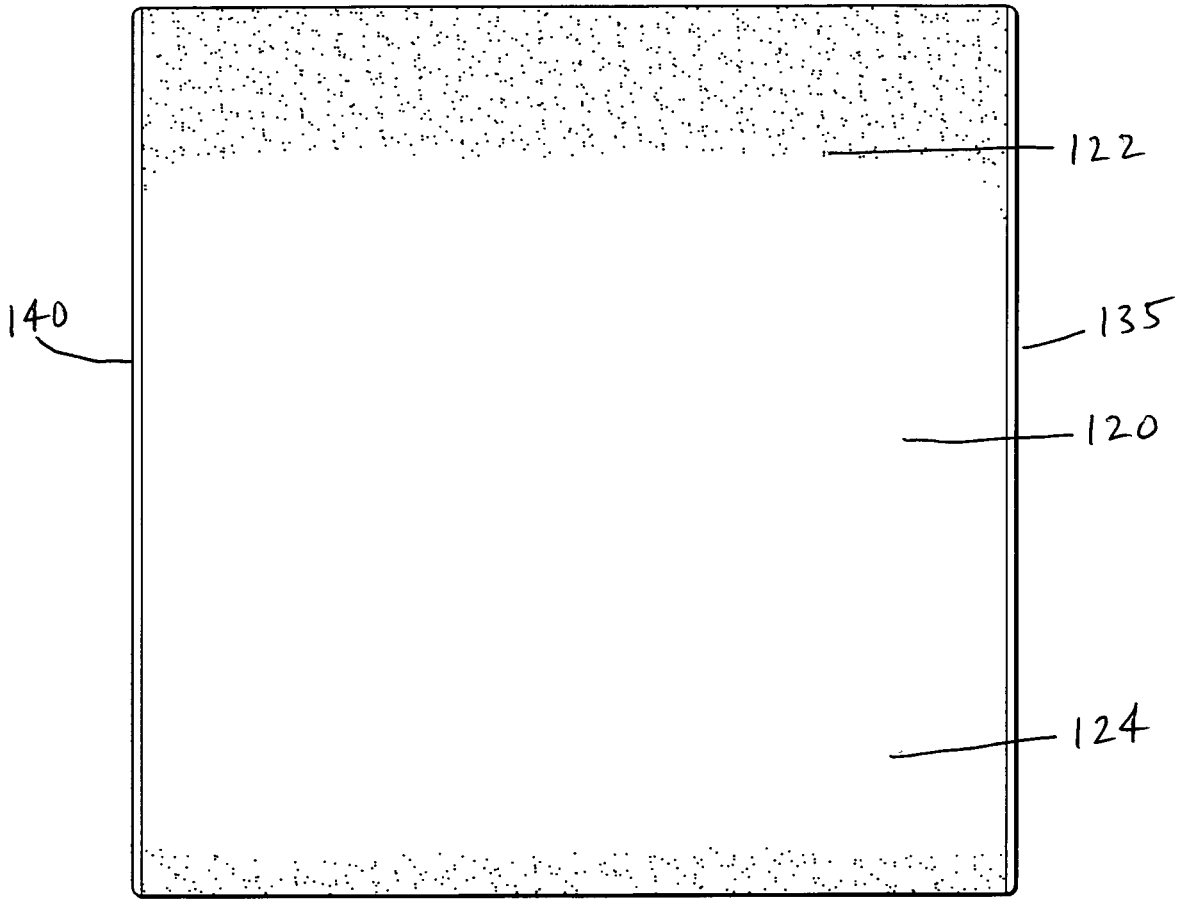
FIG. 14 shows a bottom view of the second embodiment of this invention.

The shape of the bottom surface 120 of the cushion 110 can be seen in FIG. 12 which shows one possible shape of the bottom surface. In this preferred embodiment, the bottom surface 120 of the cushion 110 can be a continuously curved two-dimensional curve along the entire bottom surface. The bottom surface 120 may have no curve from first side 135 to second side 140 of the cushion 110; rather, the bottom surface 120 can be relatively flat from first side 135 to second side 140.

The two-dimensional curve is a curve of continually decreasing radius from one end of the cushion 110 to the other. In FIG. 12, the curve of the bottom surface 120 at the left in the figure and designated 124 is a curve having a relatively large radius. As the curve proceeds to the right side in the figure, the radius of the continuing curve progressively decreases such that toward the right side, designated 122 in the figure, the curve has a radius that is relatively smaller than the portion of the curve designated 124. Stated another way, the curve of bottom surface 120 in the region designated 122 is more curved than is the region designated 124.

Alternatively, the bottom surface 120 of the cushion 110 could be a discontinuous curve such that it had one or more relatively flat spots along a curved line. It could also be possible to arrange the bottom surface 120 to be relatively flat at one end and curved at the other end.

Figure 15:
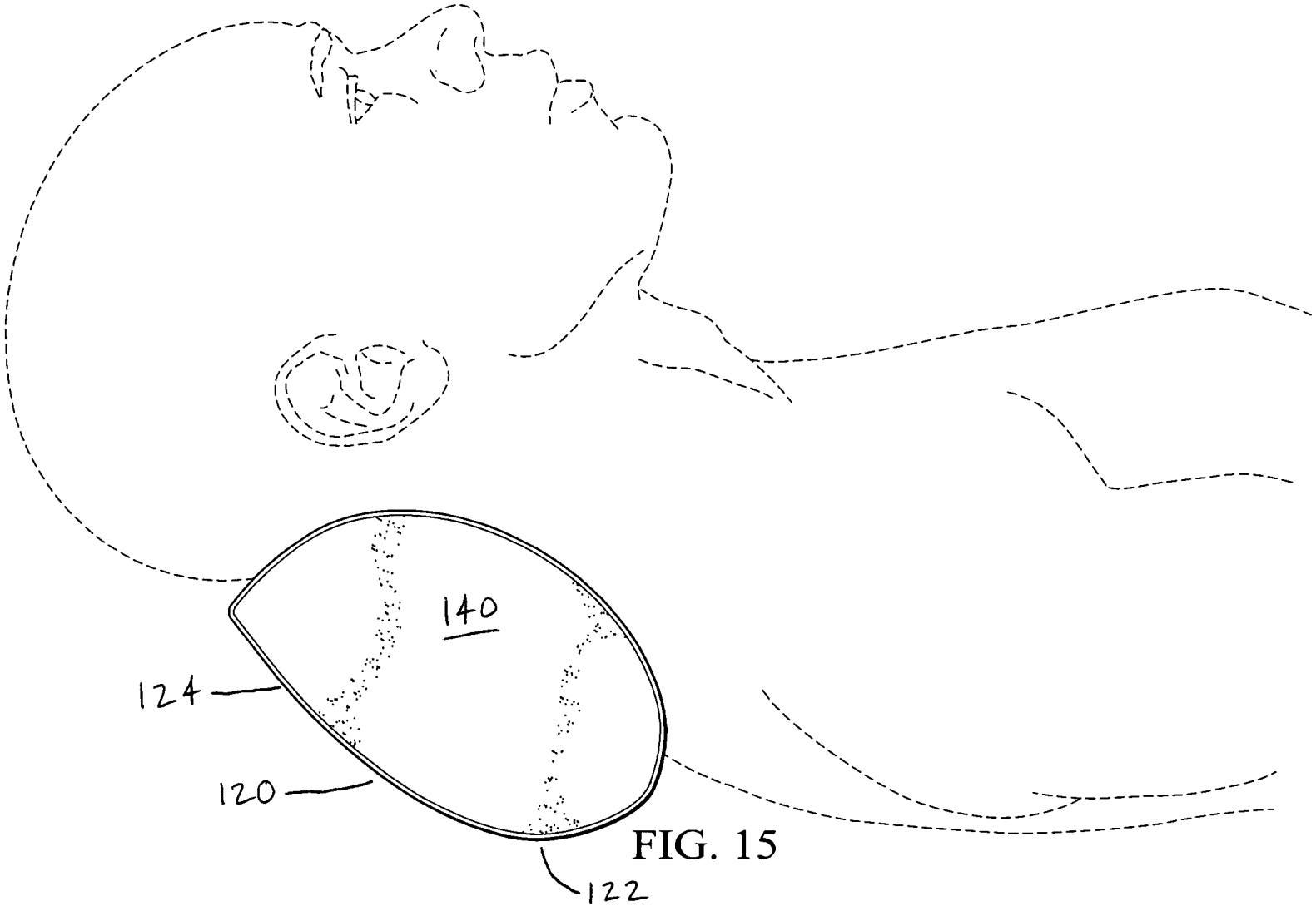
FIG. 15 shows the second embodiment in use in its initial position.
Figure 16:
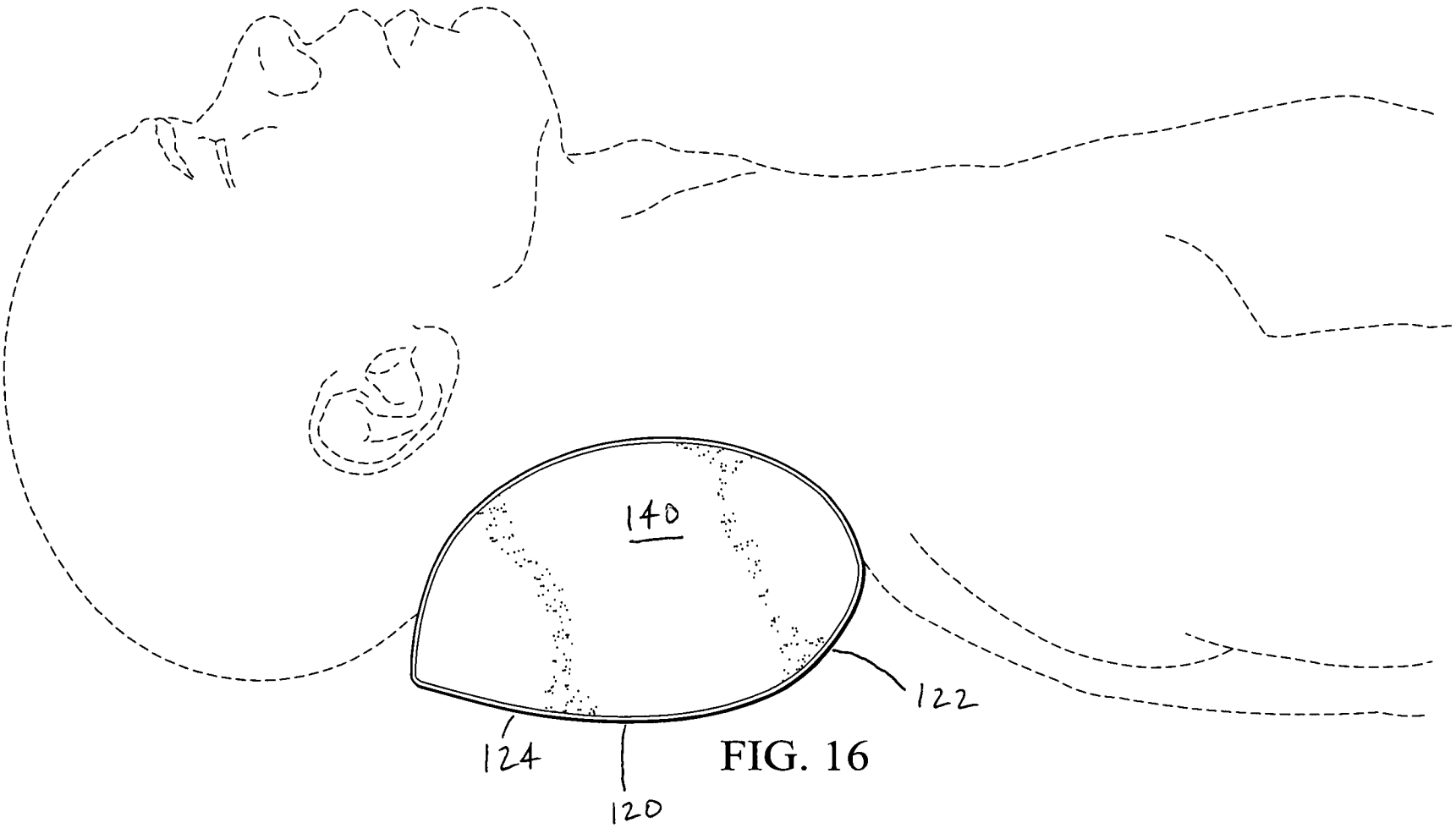
FIG. 16 shows the second embodiment in use in its final position.

The functioning of the cushion 110 in use can be seen in FIGS. 15 and 16. In FIG. 15, the user has laid down supine on a resting surface (not shown), which could be the floor, a sofa, a bed, or the like. The user has positioned the cushion 110 beneath the posterior surface of his or her neck and lower head such that the cushion's first bottom surface 122 contacts the resting surface. In so doing, the person simply lies down on the cushion 110 in the manner that is normal to a person lying down on a pillow or cushion. However, the person may need to use one or both hands to hold the cushion 110 in the orientation shown in FIG. 15 while the person lies down on the resting surface. Then, the person gently causes his or her body to extend in the direction of the top of the person's head and away from the person's shoulders, which causes the cushion 110 to rotate counterclockwise in FIGS. 15 and 16 such that the cushion 110 rocks along its curved bottom surface toward curve 124 in the same manner as a common rocking chair. The person may stop moving and come to rest at some point along the portion of the curve of the bottom surface 120 with a relatively larger radius. The person will then lie more or less in this position for a period of rest. The rocking of cushion 110 along its curved bottom surface and the associated movement of the cushion as a whole will tend to stretch or decompress the person's spinal column providing a useful benefit.

The bottom surface 120 of the cushion 110 can have a two-dimensional curved surface that has the form of a part of a two-dimensional spiral, such as an Archimedean spiral, a hyperbolic spiral, a logarithmic spiral, or the like. A spiral is characterized as being the plane curve generated by a first point moving round a fixed point while constantly approaching or receding from it. A spiral can also be characterized as a curve that progressively increases or decreases in radius along the length of the curve.

Persons of ordinary skill in this art will understand that the particular curve shown in FIGS. 15 and 16 is only one of many curves that will accomplish the purpose of this invention. Such persons of ordinary skill will be able to conceive of different bottom surfaces that employ the principles disclosed in this invention and accomplish the purposes of this invention, and those obvious variants come within the scope of this invention.

It is apparent that both embodiments of this invention demonstrate that the cushion 110, viewed from either side, functions like a cam with respect to the user's spinal column to stretch or decompress the spinal column of the person who uses the cushion 110 in the manner disclosed above.

The two embodiments of the invention described above are only examples of how persons of ordinary skill in this art, having read this entire disclosure, could apply the principles of this invention to accomplish the purposes stated herein. Persons of ordinary skill in this art will be able to devise similar devices and methods using the principles disclosed and those embodiments come within the scope of this invention. This invention is not limited, however, to the embodiments disclosed or to obvious variants thereof. This invention is limited only by the following claims.

I claim:

1. A cushioned cam means for stretching a human spine when the human lies supine, the cushioned cam means comprising:

1) a cushion means for supporting the head and neck of a supine human; and
2) a cam means attached to the cushion means for rotating the cushion means, thereby stretching the spine of the human lying prone on the cushion.

2. A method of decompressing the spinal cord of a human comprising the steps of:

1) placing a cam means for rotating a cushion means between a resting surface and the neck of the human; and 2) causing the human to rest the human's neck on the cam means, which causes the cam means to rotate, thereby causing the cam means to push the human's head away from the human's torso.

* * * * *